US007201239B1

(12) United States Patent
Perry

(10) Patent No.: US 7,201,239 B1
(45) Date of Patent: Apr. 10, 2007

(54) POWER-GENERATING DEVICE FOR USE IN DRILLING OPERATIONS

(75) Inventor: Carl Allison Perry, Middletown, CT (US)

(73) Assignee: APS Technologies, Inc.

( * ) Notice: Subject to any disclaimer, the term of this patent is extended or adjusted under 35 U.S.C. 154(b) by 261 days.

(21) Appl. No.: 10/837,727

(22) Filed: May 3, 2004

(51) Int. Cl.
*E21B 4/04* (2006.01)

(52) U.S. Cl. ..... 175/104; 175/101; 175/106

(58) Field of Classification Search ..... None
See application file for complete search history.

(56) References Cited

U.S. PATENT DOCUMENTS 5,448,227 A * 9/1995 Orban et al. ..... 340/854.4
5,517,464 A 5/1996 Lerner et al. ..... 367/84
5,626,200 A 5/1997 Gilbert et al. ..... 175/40
6,123,561 A 9/2000 Turner et al. ..... 439/194
6,257,356 B1 7/2001 Wassell ..... 175/61
6,547,016 B2 4/2003 Wassell ..... 175/45
2005/0200210 A1* 9/2005 Kotsonis et al. ..... 310/15

* cited by examiner

*Primary Examiner*—Zakiya W. Bates
(74) *Attorney, Agent, or Firm*—Woodcock Washburn LLP

(57) ABSTRACT

A preferred embodiment of a power-generating device for use in drilling operations comprises a turbine comprising a housing, and a rotor assembly rotatably coupled to the housing so that the rotor assembly rotates in response to the passage of drilling mud therethrough. The power-generating device also comprises one of an alternator and a generator assembly comprising a magnet, a winding, and a housing. The power-generating device further comprises one or more wires for transmitting electrical signals between a first and a second electrical component by way of the power-generating device. The one or more wires are routed through the housing of the turbine and the housing of the one of an alternator and a generator.

28 Claims, 6 Drawing Sheets

POWER-GENERATING DEVICE FOR USE IN DRILLING OPERATIONS

FIELD OF THE INVENTION

The present invention relates to devices for generating power during drilling operations such as oil or natural gas drilling. More particularly, the invention relates to a device suitable for use in a drill hole and having a turbine-driven alternator or generator for generating electrical power.

BACKGROUND OF THE INVENTION

Drilling operations, such as oil or natural gas drilling, are often conducted using electrical equipment, such as sensors, data storage and transmission devices, located within a drilling collar. The electrical equipment is usually inserted within the drilling collar used to transmit torque from the surface to the drill bit. Electrical power for the equipment is often supplied by one or more batteries.

The use of batteries to power electrical equipment located within a drill hole can present disadvantages. For example, batteries require periodic replacement. The need to replace batteries can cause interruptions in drilling operations. The down-time associated with such interruptions can result in substantial losses in revenue. Moreover, the cost of replacement batteries over time can be substantial.

The amount of power available from batteries can be relatively limited. In particular, it can be difficult to obtain the amount of power required for certain applications from a battery small enough to fit within the limited confines of a drilling collar. Also, batteries are not particularly well suited for exposure to the relatively high temperatures that can occur within a drill hole during drilling operations.

Alternators (or direct-current generators) can be used as an alternative power source to batteries. For example, an alternator can be equipped with a turbine that drives the alternator. The turbine can be driven by the passage of drilling mud therethrough. (Drilling mud (mud slurry) is commonly pumped through the drilling collar from the surface during drilling operations. The drilling mud helps to cool the drill bit, clear the drill bit of drilling debris, and carry cuttings to the surface.)

The use of an alternator (or generator) to power electrical equipment located in a drill hole can present disadvantages. For example, the wiring used to transmit signals to and from the electrical equipment can be difficult to route over the alternator. Hence, the alternator is usually positioned above or below the electrical equipment it powers. This arrangement can interfere with (or prevent) the use of certain types of electrical equipment that need to be located below the other equipment in the drilling collar.

Turbine-driven alternators can be susceptible to contamination by the drilling mud. In particular, the static pressure of the drilling mud increases with the depth of the drill hole, and can be extreme near the bottom of a relatively deep drill hole. Hence, an inflow of drilling mud into components such as bearings can occur if adequate precautions are not taken to seal the components. Moreover, the magnets of the alternator, if not isolated from the drilling mud and casing scale, can attract and retain the metallic debris, such as drill-bit shavings, that is usually present in drilling mud. This debris can interfere with or damage the magnets, and can result in jamming.

The overall form factor of the turbine-driven alternator can make it difficult to fit a turbine-driven alternator within the relatively narrow confines of a drilling collar in some applications. These difficulties can be exacerbated by the need to make the components of the turbine-driven alternator strong enough to resist the substantial mechanical stresses associated with drilling operations.

SUMMARY OF THE INVENTION

A preferred embodiment of a power-generating device for use in drilling operations comprises a turbine comprising a housing, and a rotor assembly rotatably coupled to the housing so that the rotor assembly rotates in response to the passage of drilling mud therethrough. The power-generating device also comprises one of an alternator and a generator assembly comprising a magnet, a winding, and a housing. One of the magnet and the winding is fixedly coupled to the housing of the one of an alternator and a generator, and the other of the magnet and the winding is coupled to the rotor assembly so that rotation of the rotor assembly causes a magnetic field of the magnet to pass through the winding thereby causing the one of an alternator and a generator to generate electrical power.

The power-generating device further comprises one or more wires for transmitting electrical signals between a first and a second electrical component by way of the power-generating device. The one or more wires are routed through the housing of the turbine and the housing of the one of an alternator and a generator.

Another preferred embodiment of a power-generating device for use in drilling operations comprises a turbine comprising a housing and a rotor assembly. The rotor assembly comprises a hub and a plurality of blades fixedly coupled to the hub. The rotor assembly is rotatably coupled to the housing so that the rotor assembly generates a first torque in response to the passage of drilling mud over the blades. The power-generating device further comprises a gearbox mechanically coupled to the turbine so that a torque approximately equal to the first torque is input to the gearbox. The gearbox comprises a plurality of gears for increasing the torque approximately equal to the first torque so that the gearbox generates an output torque greater than the torque approximately equal to the first torque.

The power-generating device further comprises one of an alternator and a generator for generating electrical power and comprising a magnet and a winding. The one of an alternator and a generator is mechanically coupled to the gearbox so that the one of the magnet and the winding rotates in relation to the other of the magnet and the winding in response to the output torque.

Another preferred embodiment of a power-generating device comprises a turbine comprising a first housing, a bearing, and a rotor assembly rotatably coupled to the first housing by way of the bearing so that the rotor assembly rotates in response to the passage of drilling mud therethrough. At least a portion of the bearing is located in a cavity defined by the first housing. The cavity has lubricating oil therein.

The power-generating device further comprises one of an alternator and a generator. The one of an alternator and a generator comprises a magnet, a winding, and a second housing for magnet and the winding. The second housing has lubricating oil in an interior thereof. The one of an alternator and a generator is mechanically coupled to the rotor assembly so that rotation of the rotor assembly causes relative movement between the magnet and the winding thereby causing the one of an alternator and a generator to generate electrical power.

The power-generating device also comprises a piston. A first side of the piston is in fluid communication with the cavity and the interior of the second housing, and a second side of the piston is in fluid communication with an ambient environment around the power-generating device so that a pressure of the lubricating oil in the cavity and the second housing varies in response to a variation in a pressure of the ambient environment.

Another preferred embodiment of a power-generating device comprises a turbine comprising a housing, a bearing located at least in part within a cavity defined by the housing, a rotor assembly rotatably coupled to the housing by way of the bearing so that the rotor assembly rotates in response to the passage of drilling mud through the rotor assembly, a shaft fixedly coupled to the rotor assembly, and a seal assembly. The seal assembly comprises a rotary face concentrically disposed around the shaft, and a stationary face fixedly coupled to the housing and abutting the rotary face so that a contact pressure between the rotary face and the stationary face substantially seals the cavity.

The power-generating device also comprises one of an alternator and a generator comprising a magnet, a winding, and a housing. One of the magnet and the winding is fixedly coupled to the housing of the alternator, and the other of the magnet and the winding being coupled to the shaft so that rotation of the rotor assembly causes a magnetic field of the magnet to pass through the winding thereby causing the one of an alternator and a generator to generate electrical power.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

A preferred embodiment of a power-generating device 10 is depicted in FIGS. 1–8. The figures are each referenced to a common coordinate system 12 depicted therein. The power-generating device 10 can be used during MWD or LWD operations. The power-generating device 10 includes a turbine-driven alternator that can generate electrical power for use by electrical equipment, such as sensors, and data storage and transmission devices, located in the drilling collar.

Figure 8:
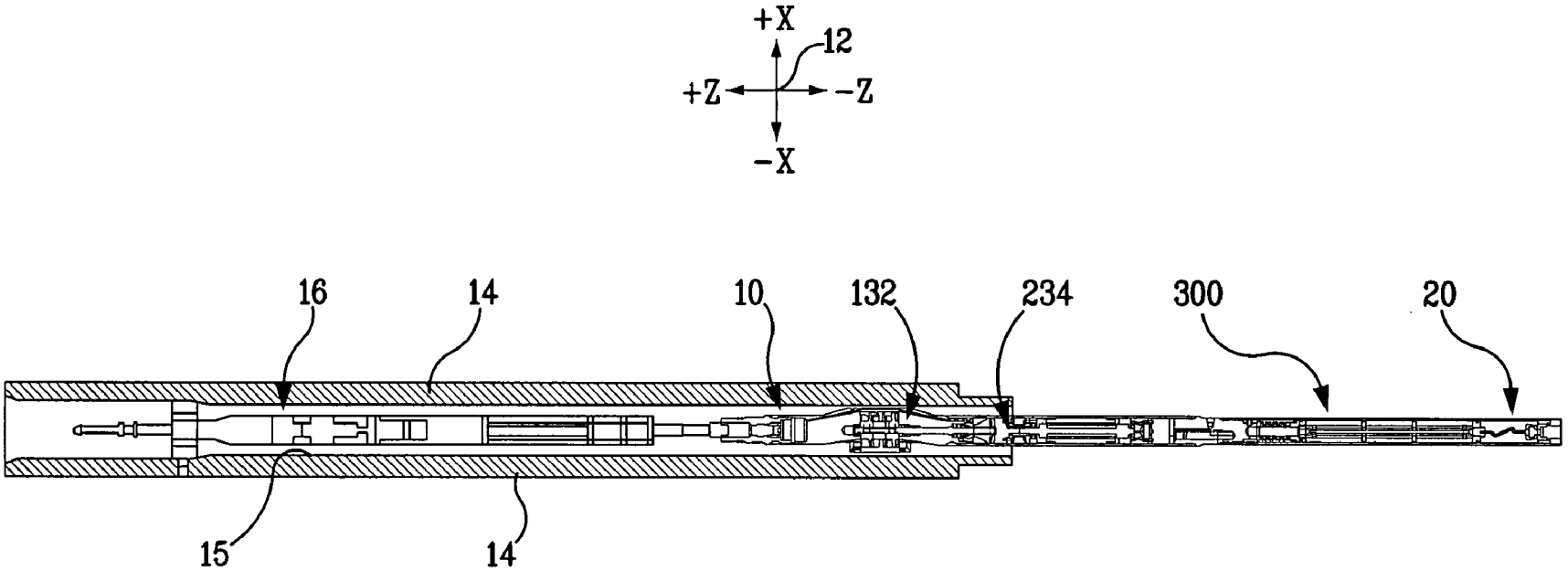
FIG. 8 depicts a longitudinal cross-section of the power-generating unit shown in FIGS. 1–7, installed in a drilling collar and mechanically and electrically coupled to a pulser assembly and a crossover.

FIG. 8 depicts the power-generating device 10 in an exemplary operating environment. The power-generating device 10 is configured for use within a length of a drilling collar 14 (only a portion of the drilling collar 14 is depicted in FIG. 8). The drilling collar 14 transmits axial or torsional forces to drill a drill bit located down-hole thereof, by way of other sections of drilling collar. The drilling collar 14 has an inner surface 15 configured to accommodate the outer contours of the power-generating device 10.

Drilling mud is pumped through the drilling collar 14 (and the other sections of drilling collar) to the drill bit during drilling operations. The power-generating device 10, as explained in detail below, uses the force of the drilling mud passing thereover to generate electrical power.

The power-generating device 10 can be suspended from another piece of equipment, such as a pulser assembly 16, located in a section of a second drilling collar 14 immediately above (up-hole of) the drilling collar 14. (The power-generating device 10 and the drilling collar 14 are depicted in a horizontal orientation in FIG. 8 for exemplary purposes. The power-generating device 10 and the drilling collar 14 are commonly used in a substantially vertical orientation during drilling operations.)

Electrical equipment, such as sensors, data storage and transmission devices, etc. (not shown), can be suspended from the power-generating device 10.

The power-generating device 10 can be used to power the electrical equipment suspended therefrom (the power-generating device 10 can also be used to power the electrical equipment from which it is suspended). Moreover, electrical signals can be transmitted to and from the electrical equipment through the power-generating device 10, as discussed below. (The power-generating device 10 is shown in FIG. 8 with a crossover 20 connected thereto, for exemplary purposes. The crossover 20 can be used to electrically connect the power-generating device 10 to a piece of equipment having an electrical connector that is not compatible with the connector on the power-generating device 10.)

The power-generating device 10 comprises a bull plug assembly 110 having a body 111. The body 111 has a first cavity 114 and a second cavity 116 formed therein (see FIG. 3). The second cavity 116 is located forward (uphole) of the first cavity 114.

The forward and rearward directions correspond respectively to the "+z" and "−z" directions denoted in the figures. These terms are used with reference to the component orientations depicted in FIGS. 1–5, and are used for illustrative purposes only. The power-generating device 10, as discussed above, is commonly used in a substantially vertical orientation during drilling operations. The "forward" and "rearward" directions defined herein correspond respectively to the up-hole and down-hole directions when the power-generating device 10 is used in a vertical orientation during drilling operations.

The power-generating device 10 also comprises a multi-pin wall-mount connector 117. (It should be noted that the configuration of the connector 117 is application dependent. Other types of connectors can be used in alternative embodiments.)

The connector 117 is mounted on the body 111 of the bull plug assembly 110, so that a portion of the connector 117 extends into the second cavity 116.

The connector 117 can mate with a complementary connector on the piece of equipment located immediately uphole of the power-generating device 10, e.g., the pulser assembly 16. The connector 117 can transmit electrical power and electrical signals (including signal and ground information) between the power-generating device 10 and the pulser assembly 16. Threads can be formed on an outer surface of the body 111 to facilitate mating of the power-generating unit 10 with the pulser assembly 16.

Figure 1:
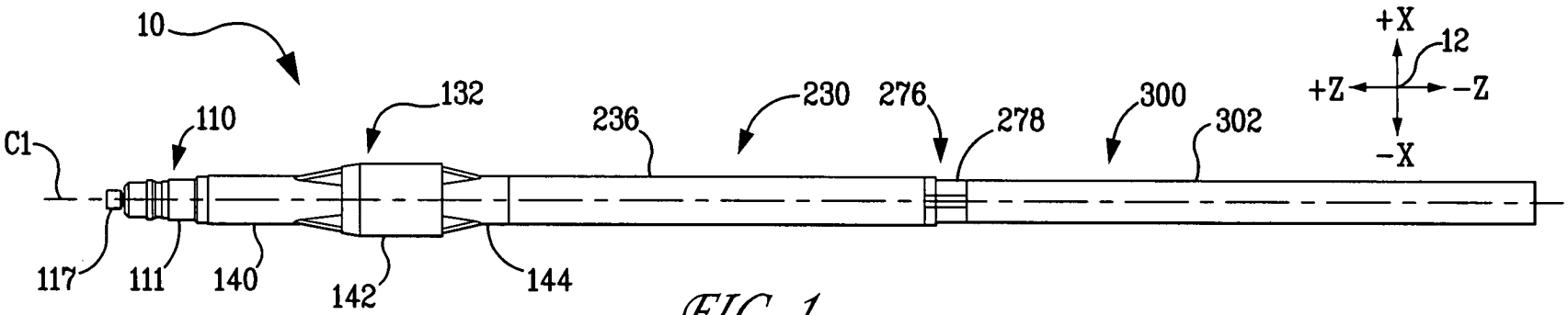
FIG. 1 is a side view of a preferred embodiment of a power-generating device.
Figure 2:
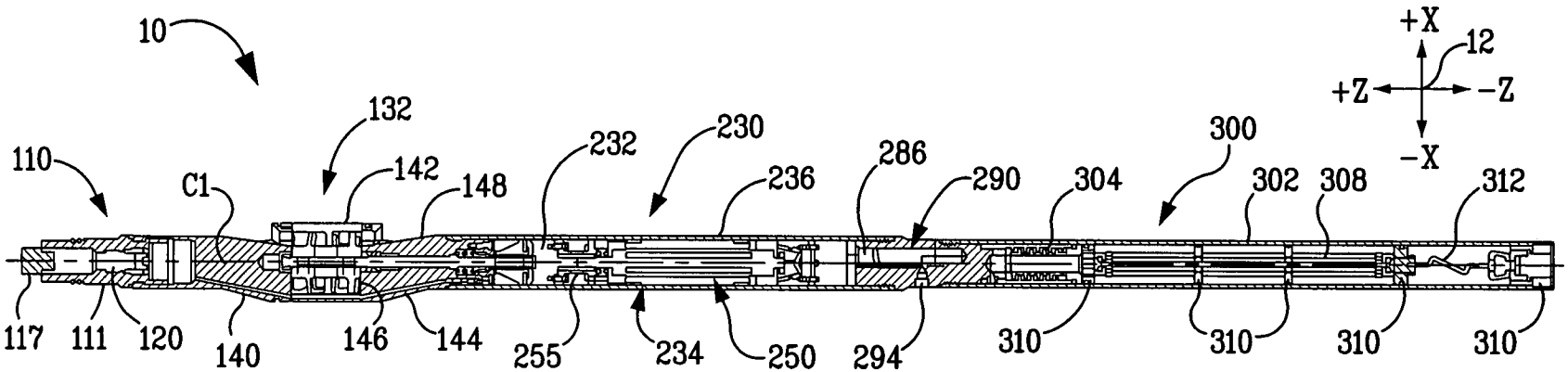
FIG. 2 depicts a longitudinal cross-section of the power-generating device shown in FIG. 1.
Figure 3:
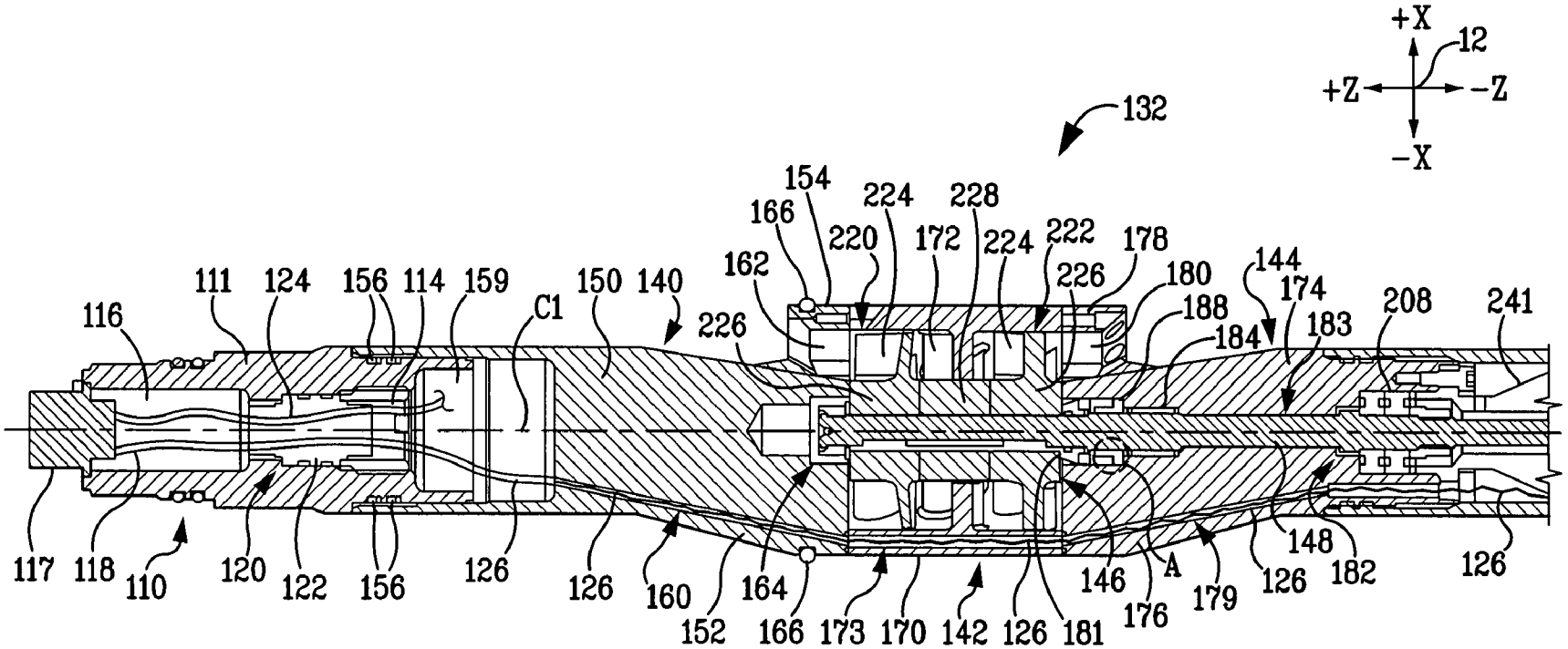
FIG. 3 depicts a portion of the longitudinal cross-section shown in FIG. 2.

A plurality of wires 118 are connected to the connector 122, and extend through the second cavity 116 (see FIG. 3).

The bull plug assembly 110 comprises a high-pressure feed thru 120. The high-pressure feed thru 120 is secured to the body 111, and is located between the first and second cavities 114, 116. The high-pressure feed-thru 120 comprises a body 122, and a plurality of electrically-conductive pins 124 embedded in the body 122. The body 122 is formed from an electrically-insulating material, and is preferably formed from a molded plastic such as polyetheretherketone (PEEK). Each of the wires 118 is electrically connected to a forward end of a corresponding one of the pins 124.

The high-pressure feed-thru 120 substantially seals the first cavity 114 from the second cavity 116, and can thereby inhibit contaminates such as drilling mud from entering the first cavity 114.

The rearward end of each pin 124 is electrically connected to one of a plurality wires 126. The wires 126 extend through the first cavity 114.

The second cavity 116 of the bull plug assembly 110 contains air at approximately atmospheric pressure during operation of the power-generating device 10. The first cavity 114 is filled with lubricating oil. The lubricating oil can be a suitable high-temperature, low compressability oil such as MOBIL 624 synthetic oil. (Details relating to the pressurization of the lubricating oil are presented below.)

The high-pressure feed thru 120 acts as bulkhead that substantially isolates the pressurized lubricating oil in the first cavity 114 from the unpressurized air in the second cavity 116. The high-pressure feed thru 120 performs this function while permitting electrical power and electrical signals to pass between the first and second cavities 114, 116 by way of the pins 124.

The power-generating device also comprises a turbine 132. The turbine 132 comprises an inlet housing 140, a stator housing 142, and an outlet housing 144 (see FIG. 3). The turbine 132 also comprises a rotor assembly 146, and a shaft 148.

The inlet housing 140 includes a main portion 150, and three legs 152 that adjoin the main portion 150. The inlet housing 140 also includes a circumferentially-extending shroud 154 that adjoins each of the legs 152. The shroud 154 is located proximate the rearward end of the inlet housing 140.

The inlet housing 140 is preferably secured to the bull plug assembly 110 by complementary threads formed on an outer surface of the body 111 of the bull plug assembly 110, and an inner surface of the main portion 150 of the inlet housing 140. The joint between the bull plug assembly 110 and the inlet housing 140 is preferably sealed through the use of O-ring seals and back-up rings 156 positioned in circumferentially-extending grooves formed in the body 111.

The inlet housing 140 has a first passage 159 formed therein. The first passage 159 adjoins the first cavity 114 of the bull plug assembly 110 when the inlet housing 140 is mated with the bull plug assembly 110. The first passage 159 receives the wires 126 as the wires 126 exit the first cavity 114.

The inlet housing 140 has three wireways 160 formed therein (only one of the wireways 160 is depicted in the figures). Each wireway 160 extends from the passage 159 and through a respective one of the legs 152. The wires 126 are routed between the passage 159 and the rearward end of the inlet housing 140 by way of the wireways 160.

The area between the shroud 154 and the main portion 174 of the inlet housing 140 forms passages 162 for drilling mud to enter the stator housing 142.

The inlet housing 140 also has a second cavity 164 formed therein. The second cavity 164 is located proximate the rearward end of the inlet housing 140, and accommodates the forward end of the shaft 148.

An O-ring seal 166 is positioned in a groove formed around an outer circumference of the shroud 154 of the inlet housing 140. The O-ring seal 166 helps to seal the interface between the shroud 154 and an inner circumference of the drilling collar 14. The O-ring seal 166 thereby causes substantially all of the drilling mud passing over the power-generating device 10 to flow into and through the passages 162.

The stator housing 142 comprises a circumferentially-extending shroud 170, and a plurality of stator blades 172. The stator blades 172 adjoin the shroud 170, and extend inward (toward a centerline C1 of the power-generating device 10) from the shroud 170.

The shroud 170 has three wireways 173 formed therein (only one of the wireways 173 is depicted in the figures). The wireways 173 each extend between the forward and rearward ends of the shroud 170. The stator housing 142 is mated with the inlet housing 140 so that each of the wireways 173 substantially aligns with a corresponding one of the wireways 160 formed in the inlet housing 140. The wires 126 are routed through the stator housing 142 by way of the wireways 173.

The outlet housing 144 includes a main portion 174, and three legs 176 that adjoin the main portion 174. The outlet housing 144 also includes a circumferentially-extending shroud 178 that adjoins each of the legs 176. The shroud 178 is located proximate the forward end of the outlet housing 144.

The outlet housing 144 has three wireways 179 formed therein (only one of the wireways 179 is depicted in FIG. 3). Each wireway 179 extends between the forward and rearward ends of the outlet housing 144, and through a respective one of the legs 152. The outlet housing 144 is mated with the stator housing 142 so that each of the wireways 179 substantially aligns with a corresponding one of the wireways 173 in the stator housing 142. The wires 126 are routed through the outlet housing 144 by way of the wireways 179.

The area between the shroud 178 and the main portion 174 of the outlet housing 144 forms a passage 180 for the drilling mud as the drilling mud exits the stator housing 142.

The stator housing 142 can be secured to the inlet housing 140 and the outlet housing 144 using threaded fasteners (not shown) that extend through bores formed in the shroud 178 of the outlet housing 144 and the shroud 170 of the stator housing 142. The fasteners engage threaded holes formed in the shroud 154 of the inlet housing 140.

The stator housing 154 preferably comprises a first plurality of pins (not shown) that extend axially, in the "+z" direction," from the shroud 170. The pins engage corresponding bores formed in the shroud 154 of the inlet housing 140, and can transmit torsional forces between the inlet housing 140 and the stator housing 142 (thereby preventing the fasteners that secure the stator housing 142 to the inlet housing 140 and the outlet housing 144 from being subject to substantial shear stresses).

The stator housing 142 preferably comprises a second plurality of pins (not shown) that extend axially, in the "−z" direction, from the shroud 170. The pins engage corresponding bores formed in the shroud 178 of the outlet housing 144, and can transmit torsional forces between the inlet housing 140 and the stator housing 142 (thereby preventing the fasteners that secure the stator housing 142 to the inlet housing 140 and the outlet housing 144 from being subject to substantial shear stresses).

The outlet housing 144 has a first cavity 181, a second cavity 182, and a central passage 183 formed therein. The central passage 183 adjoins the first and second cavities 181, 182. The shaft 148 extends through the first and second cavities 181, 182, and the central passage 183.

The shaft 148 is supported, in part, by a needle bearing 184 located within the first cavity 181. The needle bearing 184 facilitates rotation of the shaft 148 in relation to the outlet housing 144, and is wetted by pressurized lubricating oil that fills the first cavity 181, the second cavity 182, and the central passage 183.

The first cavity 181 is sealed by a seal assembly 188. The seal assembly 188 is preferably a rotating face seal. The seal assembly 188 preferably comprises a rotary face 190, a stationary face 192, and a seal housing 194 for supporting stationary face 192 (see FIG. 7). The rotary face 190 and the stationary face 192 are preferably formed from tungsten carbide or other suitable wear-resistant materials. The seal assembly 188 further comprises a retainer 196 for retaining the stationary face 192 in the seal housing 194. The retainer 196 and the seal housing 194 are configured to permit a limited degree of axial movement of the stationary face 190 in relation to the seal housing 194. The seal assembly 188 also comprises a spring 198 for biasing the stationary face 192 toward the rotary face 190.

The rotary face 190 is concentrically disposed around the shaft 148, and rotates with the shaft 148. An O-ring seal 200 is positioned within a groove formed in the rotary face 190. The O-ring seal 200 helps to seal the interface between the rotary face 190 and the shaft 148.

The stationary face 192 is secured to the outlet housing 144. An O-ring seal 202 is positioned within a groove formed within the seal housing 194, and helps to seal the interface between the stationary face 192 and the seal housing 194.

The stationary face 192 is exposed to the pressurized lubricating oil within the first cavity 181. Contact between the adjacent surfaces of the stationary face 192 and the rotary face 190 helps to seal the first cavity 181. In other words, the noted contact can inhibit the pressurized lubricating oil from leaking out of the first cavity 181, and can inhibit the inflow of drilling mud or other contaminants into the first cavity 181.

The force exerted by the pressurized lubricating oil on the stationary face 192 urges the stationary face 192 in the rearward direction, toward the rotary face 190. Movement of the stationary face 192 toward the rotary face 190 increases the contact pressure (and the sealing stresses) between the rotary face 190 and the stationary face 192. Hence, the sealing force between the rotary face 190 and the stationary face 192 increases with the pressure of the lubricating oil.

A particular configuration for the seal assembly 188 has been described in detail for exemplary purposes only. Seals having other configurations can be used in alternative embodiments of the power-generating device 10.

Figure 4:
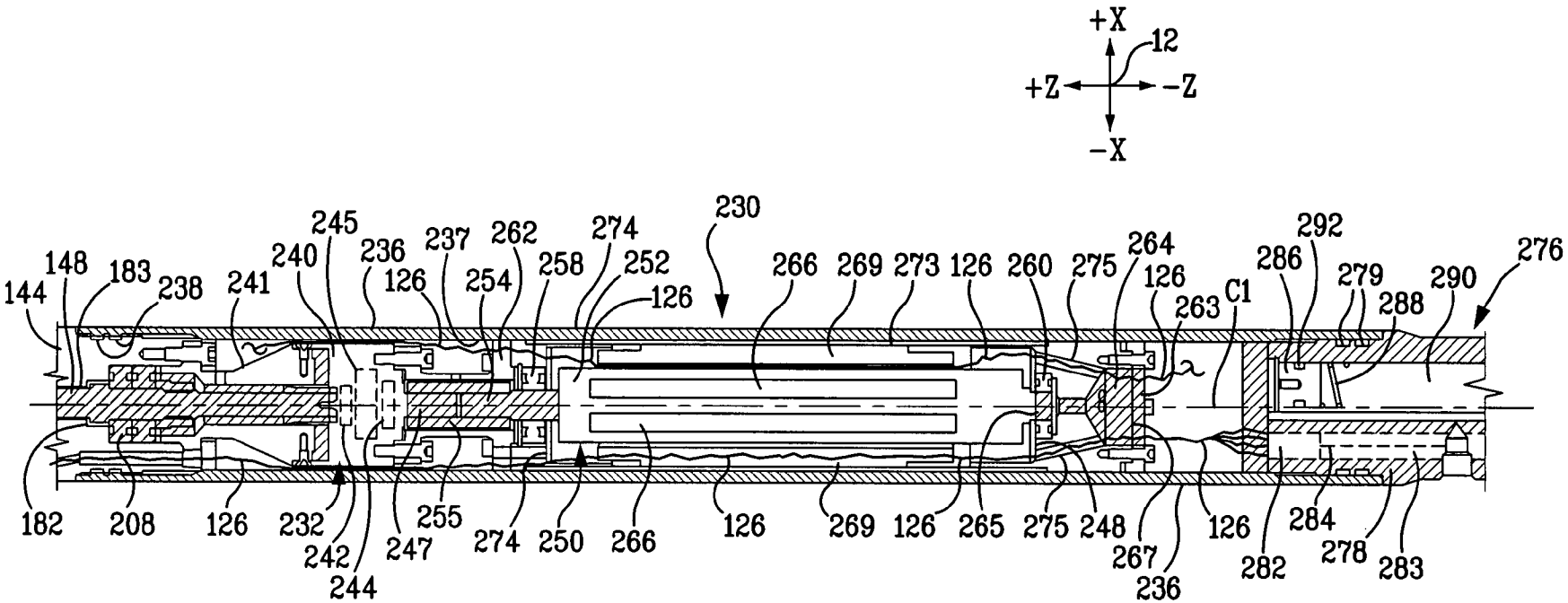
FIG. 4 depicts a another portion of the longitudinal cross-section shown in FIG. 2.

The shaft 148 is further supported by bearings 208 located within the second cavity 182 (see FIGS. 3 and 4). The bearings 208 facilitate rotation of the shaft 148 in relation to the outlet housing 144. The bearings 208 are thrust bearings that can restrain the shaft 148 radially (in the "±y" and "±x" directions) and axially (in the "−z" direction). The bearings 208 are wetted by the pressurized lubricating oil that fills the second cavity 182 during operation of the power-generating device 10.

The rotor assembly 146 has a first stage 220 and a second stage 222 (see FIG. 3). The first and second stages 220, 222 each comprise a hub 224, and a plurality of blades 226 integrally formed with the hub 224. The blades 226 are spaced apart along an outer periphery of the corresponding hub 224. The hubs 224 are fixedly coupled to the shaft 148 (the rotor assembly 146 can thus rotate in relation to the inlet housing 140, stator housing 142, and outlet housing 144, and is rotatably coupled inlet housing 140, stator housing 142, and outlet housing 144 by way of the shaft 148 and the bearings 184). The blades 226 of the first stage 220 are located between the passages 162 formed in the inlet housing 140, and the stator blades 172. The blades 226 of the second stage 222 are located between the stator blades 172 and the passage 180 formed in the outlet housing 144.

The rotor assembly 146 also comprises a spacer 228 located between the hubs 224 of the first and second stages 220, 222. The spacer 228 is sandwiched between the hubs 224.

The shaft 148, as discussed above, is supported by the bearings 184, 208. The portion of the shaft 148 forward of the bearing 184 thus acts as a cantilever that supports the rotor assembly 146. It should be noted that the forward end of the rotor assembly 146 can be supported by an additional bearing in alternative embodiments of the power-generating unit 10. For example, such an arrangement may be necessary in applications where the rotational speed of the rotor assembly 146 can exceed the critical speed thereof.

The turbine 132 functions as an axial-flow turbine. In particular, drilling mud is pumped through the drilling collar 14 during drilling operations, as discussed previously. The drilling mud, upon reaching the power-generating device 10, flows over the bull plug assembly 110 and the inlet housing 140. The drilling mud enters the passages 162 formed in inlet housing 140. (The O-ring seal 166 positioned around the shroud 154 of the inlet housing 140 causes substantially all of the drilling mud that reaches the power-generating device 10 to flow through the passages 162, as noted above.)

The drilling mud flows over the blades 226 of the first stage 220 of the rotor assembly 146 after exiting the passages 162. The blades 226 are shaped so that the passage of the drilling mud thereover causes the blades 226 (and the reminder of the rotor assembly 146) to rotate in a clockwise direction about the centerline C1 (when viewed from behind). (Alternative embodiments of the power-generating device 10 can be configured so that the rotor assembly 146 rotates in a counterclockwise direction.)

The rotation of the rotor assembly 146 imparts rotation to the shaft 148. The rotor assembly 146 thus rotates the shaft 148 by harnessing the force used to pump the drilling mud through the drilling collar 14.

The drilling mud flows over the stator blades 172 after exiting the first stage 220 of the rotor assembly 146. The stator blades 172 are shaped to direct the flow of the drilling mud toward the blades 226 of the second stage 222.

The blades 226 of the second stage 222 rotate about the centerline C1 in response to the passage of the drilling mud thereover. The second stage 222 thereby supplements the rotation imparted to the shaft 148 by the first stage 220.

It should be noted that the optimum number of stages for the rotor assembly 146 is application dependent. Alternative embodiments of the power-generating device 10 can be constructed with rotor assemblies having more or less than two stages.

The power-generating device 10 is subject to mechanical loads resulting from, for example, its own weight, mechanical interactions between its various components, internal fluid pressures, etc. The power-generating device 10 is also subject to mechanical loads resulting from other equipment suspended therefrom during drilling operations. The inlet housing 140, stator housing 142, and outlet housing 144 act as structural elements that can bear a portion of the axial, radial, torsional, and bending stresses that result from these loads. The inlet housing 140, stator housing 142, and outlet housing 144 are preferably formed from a high-strength, corrosion-resistant material such as Inconel 718 alloy, 17-4PH stainless steel, copper berilium alloy, etc.

The power-generating device 10 also comprises a mechanical module 230. The mechanical module 230 comprises a gearbox 232 for reducing the rotational speed of the shaft 148, and an alternator 234 for generating electrical power using the torque produced by the turbine 132.

The mechanical module 230 also comprises a pressure housing 236 for housing the gearbox 232 and the alternator 234 (see FIG. 4). The pressure housing 236 is preferably secured to the outlet housing 144 of the turbine 132 by complementary threads formed on an outer surface of the outlet housing 144, and an inner surface 237 of the pressure housing 236. The joint between the outlet housing 144 and the pressure housing 236 is preferably sealed through the use of O-ring seals and back-up rings 238 positioned in circumferentially-extending grooves formed in the outlet housing 144. The pressure housing 236 is filled with lubricating oil.

The pressure housing 236 acts as a load-bearing structural element, in the manner discussed above in relation to the inlet housing 140, stator housing 142, and outlet housing 144 of the turbine 132. The pressure housing 236 is preferably formed from a high-strength, corrosion-resistant material such as Inconel 718 alloy, 17-4PH stainless steel, copper berilium alloy, etc.

The gearbox 232 includes a housing 240 (see FIG. 4). The housing 240 is supported, in part, by a support member 241. The support member 241 is secured to the outlet housing 144 of the turbine 132. The shaft 148 of the turbine 132 is mechanically coupled to a first, or pinion, gear 242 within the gearbox 232. Torque generated by the rotor assembly 146 of the turbine 132 is transferred to the gearbox 232 by way of the shaft 148, and is input to the gearbox 232 by way of the pinion gear 242.

The gearbox 232 is lubricated by the oil within the pressure housing 236 during operation of the power-generating device 10. The lubricating oil can enter the interior of the gearbox 232 by way of through holes (not shown) formed in the housing 240, and through various bearings (also not shown) of the gearbox 232.

The gearbox 232 further includes a series of planetary gears 245, a second gear 244, and an output shaft 247 mechanically coupled to the second gear 244 (the pinion gear 242, the second gear 244, and the planetary gears 245 are depicted in diagrammatic form in FIG. 4, for clarity).

The second gear 244 is driven by the pinion gear 242 by way of the planetary gears 245. The planetary gears 245 reduce the speed of the second gear 244 (and the output shaft 247) in relation to the first gear 242 (and the shaft 148). The gearbox 232 thus functions as a reduction gearbox.

The ratio of the torque transferred from the shaft 148 to the output shaft 247 is inversely proportional to the ratio of the rotational speeds of the shaft 148 and the output shaft 247. Hence, the torque transferred from the gearbox 232 by way of the output shaft 247 is greater that that transferred to the gearbox 232 by the shaft 148. This torque multiplication is desirable because the viscosity of the lubricating oil within the alternator 234 (which is driven by the output shaft 247) causes substantial drag on the rotating components thereof, thereby necessitating a relatively large amount of driving torque.

Moreover, the speed reduction provided by the gearbox 232 can permit the alternator 234 and the rotor assembly 146 of the turbine 132 to operate closer to their respective optimum speeds than would be otherwise be possible. In other words, the alternator 234 can operate within a first range of rotational speeds, while the rotor assembly 146 can operate at a comparatively higher second range of rotational speeds (thereby enhancing the respective efficiencies of the alternator 234 and the turbine 132).

The ratio of the input speed of the gearbox 232, i.e., the rotational speed of the shaft 146, to the output speed, i.e., the rotational speed of the output shaft 247, is approximately 2:1. Hence, the torque transferred through the output shaft 247 is approximately twice that transferred through the shaft 148.

It should be noted that the optimum value for the ratio of the input to the output speeds (and torque) of the gearbox 232 is application dependent, and a particular value for this parameter is specified for exemplary purposes only. Alternative embodiments of the power-generating device 10 can use gearboxes in which the ratio of the input to output speeds is greater or less than 2:1. Alternative embodiments can also be constructed without the gearbox 232. In other words, the alternator 234 can be driven at the same rotational speed as the shaft 148 (this arrangement is particularly suited for power-generating devices in which the turbine is relatively large).

The alternator 234 functions as a self-exciting alternator. The alternator 234 comprises a housing 248 and a armature 250 (see FIG. 4). The housing 248 is secured to the inner surface 237 of the pressure housing 236 by, for example, a press fit.

The armature 250 includes a main portion 252 positioned within the housing 248. The armature 250 also includes an input portion 254 that adjoins a forward end of the main portion 252, and extends through a forward end of the housing 248. The input portion 254 is coupled to the output shaft 247 of the gearbox 232 by a torque coupling 255.

The armature 250 is supported by a first bearing 258, and a second bearing 260. The first and second bearings 258, 260 facilitate rotation of the armature 250 in relation to the housing 248 (the armature 250 is thus rotatably coupled to the housing 248 by way of the first and second bearings 258, 260).

The first bearing 258 is mounted on a adapter 262. The adapter 262 is secured to the pressure housing 236 by suitable means such as bolts (not shown). (The adapter 262 also helps to support the gearbox 232, and houses the torque coupling 255.) The first bearing 258 receives the input portion 254 of the armature 250, and can restrain the armature 250 radially and axially. The first bearing 258 is wetted by lubricating oil during operation of the power-generating device 10.

The second bearing 260 is mounted on a support 264. The support 264 is secured to the pressure housing 236 by way of a clamp 263, and an O-ring 267 positioned between the support 264 and the clamp 263.

The armature 250 includes a stub portion 265 that extends from a rearward end of the main portion 252. The second bearing 260 receives the stub portion 265. The second bearing 260 is a thrust bearing that can restrain the armature 250 radially and axially. The second bearing 260 is wetted by lubricating oil during operation of the power-generating device 10.

The alternator 234 also comprises a plurality of permanent magnets 266 (see FIG. 4). The magnets 266 are preferably rare-earth permanent magnets. The magnets 266 are embedded in an outer surface of the main portion 252 of the armature 250, by a suitable means such as adhesive (the magnets 266 thus rotate with the armature 250). The alternator 236 is preferably configured as a six-pole alternator. Hence, six of the magnets 266 are preferably fixed to the main portion 252.

The alternator 234 further comprises three windings 269. The windings 269 are secured to an inner surface of the housing 248 by a suitable means such as layer of adhesive 273 (the layer of adhesive 273 electrically insulates the windings 269 from the housing 248).

The alternator 234 is lubricated by the oil that fills the pressure housing 236. The lubricating oil can enter the interior of the alternator 234 (and thereby immerse the magnets 266 and the windings 269) by way of through holes (not shown) formed in the housing 248.

The armature 250 of the alternator 234 is rotated by the rotor assembly 146 of the turbine 132 by way of the shaft 148, the gearbox 232, and the torque coupling 255. (The rotational speed of the armature 250 is approximately half that of the rotor assembly 146 due to the speed reduction provided by the gearbox 232, as discussed above.)

Rotation of the armature 250 causes the magnets 266 to rotate in relation to the windings 269. The windings 269 and the magnets 266 are arranged so that the magnetic field produced by the magnets 266 cuts through the windings 269, thereby inducing an alternating voltage in each of the windings 269.

The windings 269 can be electrically coupled, for example, in a Wye connection so that the alternator 236 generates a three-phase alternating current output. The electrical output of the alternator 234 can be used to power equipment located above or below (up-hole or down-hole of) the power-generating device 10 during drilling operations.

It should be noted that a particular configuration for the alternator 236 has been described in detail for exemplary purposes only. Other types of alternators can be used in alternative embodiments. For example, single-phase alternators, and alternators having rotating windings and stationary magnets can be used in alternative embodiments. Moreover, a direct-current generator can be used in lieu of an alternator.

The wires 126 are routed through the mechanical module 230 as follows. The wires 126 enter the forward end of pressure housing 236 after exiting the wireways 179 formed in the outlet housing 144 of the turbine 132. The wires 126 are routed between the inner surface 237 of the pressure housing 236, and an outer surface of the housing 240 of the gearbox 232.

The wires 126 are routed through the support member 241, and through the forward end of the housing 248 of the alternator 234 by way of through holes 274 formed therein. The wires 126 are then routed along the inner surface of the housing 248, between the windings 269.

The windings 269 are electrically connected to one or more of the wires 126, to transmit the AC electrical power generated by the alternator 234 to an electronics module 300 of the power-generating device 10 (discussed below).

The mechanical module 230 comprises a plurality of wireways 275 that extend between a rearward end of the housing 248 and the support 264 (see FIG. 4). The wires 126 are routed through the wireways 275, and though the support 264 via through holes formed therein.

Figure 5:
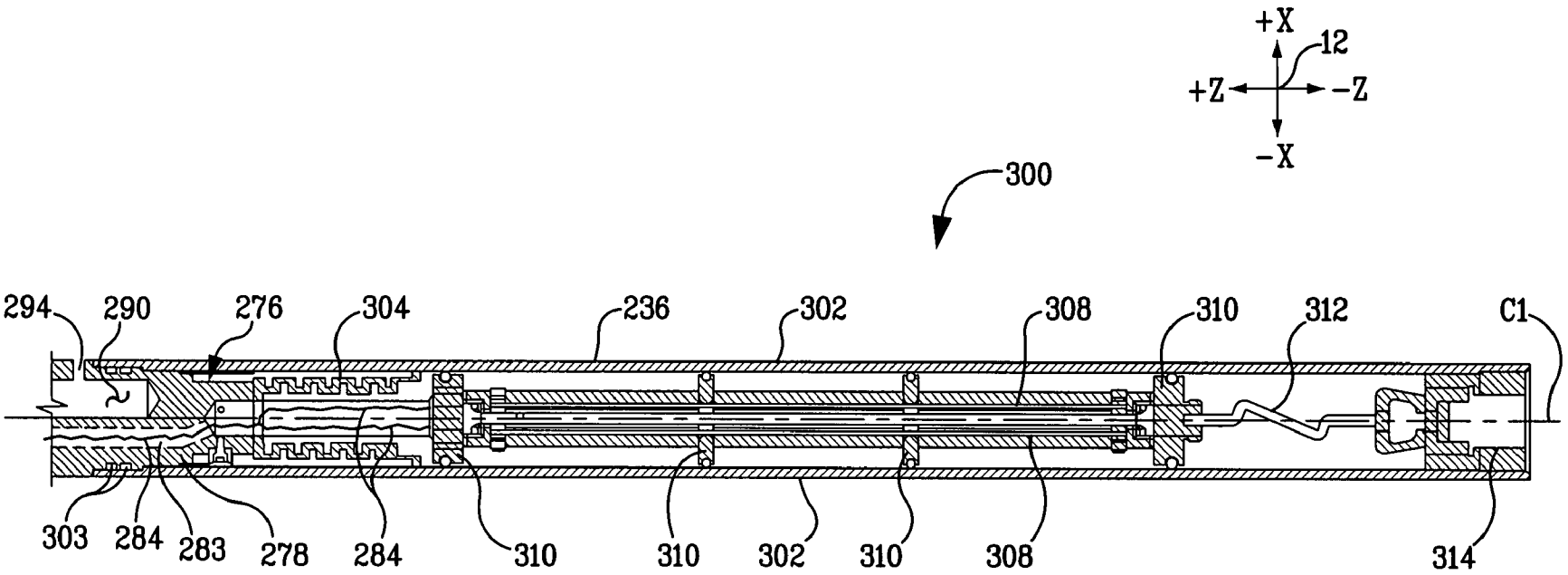
FIG. 5 depicts another portion of the longitudinal cross-section shown in FIG. 2.
Figure 6:
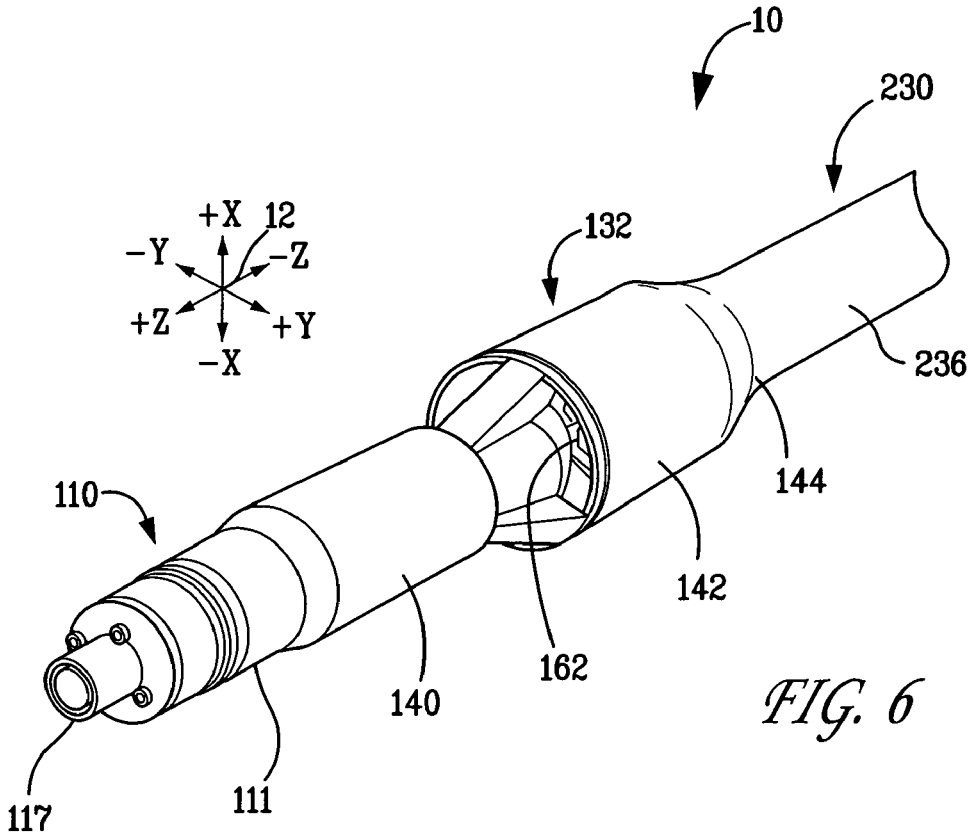
FIG. 6 is a front perspective view of the power-generating unit shown in FIGS. 1–5.
Figure 7:
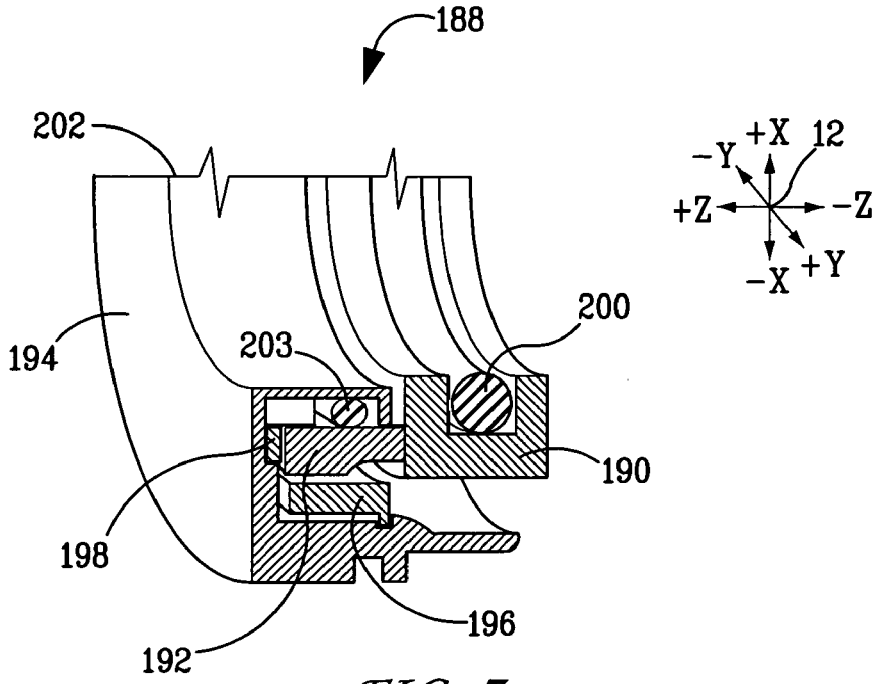
FIG. 7 is a perspective view of the area designated "A" in FIG. 3.

The power-generating device 10 further includes a pressure plug 276 located rearward of the mechanical module 230 (see FIGS. 4 and 5). The pressure plug 276 has a body 278. The pressure plug 276 is preferably secured to the pressure housing 236 by complementary threads formed on an outer surface of the body 278, and the inner surface 237 of the pressure housing 236. The joint between the pressure plug 276 and the pressure housing 236 is preferably sealed through the use of O-ring seals and back-up rings 279 positioned in circumferentially-extending grooves formed in the body 278.

The pressure plug 276 comprises two high-pressure feed thrus 282 embedded in the body 278 (only one of the high-pressure feed thrus 282 is depicted in FIGS. 4 and 5, for clarity). The high-pressure feed thrus 282 are positioned at approximately the same axial location in the pressure plug 276, and are offset from the centerline C1. Each high-pressure feed thru 282 is substantially similar to the high-pressure feed thru 120 of the bull plug assembly 110.

The wires 126 extend rearward from the support 264, and are electrically connected to the forward ends of pins embedded in each high-pressure feed thru 282. A plurality of wires 284 are electrically connected the rearward ends of the pins, and extend through passages 283 formed within the body 278 (see FIG. 5). Each passage 283 is formed rearward of a respective high-pressure feed thru 282.

The electronics module 300 is located rearward of the pressure plug 276 (see FIG. 5). The interior of the electronics module 300 contains air at approximately atmospheric pressure during operation of the power-generating device 10.

The pressure housing 236 is filled with lubricating oil during operation of the power-generating device 10, as discussed above. Each high-pressure feed thru 282 acts as a bulkhead that substantially isolates the lubricating oil in the pressure housing 236 from the air within the electronics module 300. Each high-pressure feed thru 282 performs this function while permitting electrical power and electrical signals to pass between the respective interiors of the pressure housing 236 and the electronics module 300.

The pressure plug 276 houses a piston 286 and a spring 288 (see FIG. 4; only a portion of the spring 288 is shown in FIG. 4, for clarity). In particular, the body 278 of the pressure plug 276 has a bore 290 formed therein. The bore 290 extends rearward, from a forward end of the pressure plug 276 (the bore 290 is thus open to the interior of the pressure housing 236 of the mechanical module 230). The bore 290 and the piston 286 are sized so that the piston 286 fits within the bore 290 with minimal clearance between the outer circumference of the piston 286 and the side of the bore 290. The bore 290 is offset from the centerline C1, so that pressure plug 276 can accommodate one of the high-pressure feed thrus 282 and the piston 286.

The spring 288 is positioned within the bore 290, between the piston 286 and the end of the bore 290. The spring 288 thus biases the piston 286 toward the forward direction.

An O-ring seal 292 is positioned in a groove formed around a circumference of the piston 286. The O-ring seal 292 acts as a seal between the piston 286 and the side of the bore 290.

A hole 294 is formed in the body 278 (see FIG. 5). The hole 294 extends between the bore 290, and an outer surface of the pressure plug 276. The hole 294 intersects the bore 290 at a point rearward of the range of travel of the piston 286.

The bore 290 is open to the interior of the pressure housing 236 of the mechanical module 230, as discussed above. The forward-facing side of the piston 286 is thus exposed to the lubricating oil within the pressure housing 236.

The piston 286 and the spring 288 help to maintain the pressure of the lubricating oil within the power-generating device 10 at a pressure that is minimally higher than the ambient environment around the power-generating device 10. In particular, the hole 294 places the bore 290 in fluid communication with the ambient environment around the power-generating device 10.

Drilling mud flows around the power-generating device 10 during drilling operations, as discussed above. The drilling mud can enter the bore 290 by way of the hole 294. The static pressure of the drilling mud increases with the depth of the power-generating device 10 within the drill hole. Hence, the static pressure on the rear side of the piston 286 also increases with the depth of the power-generating device 10 within the drill hole.

An increase in pressure on the rear side of the piston 286 urges the piston 286 toward the forward direction. The forward face of the piston 286 is open to the oil-filled interior of the pressure housing 236, and is thus immersed in the lubricating oil within the pressure housing 236. Urging the piston 286 toward the forward direction therefore increases the pressure of the lubricating oil within the pressure housing 236. (The pressure of the lubricating oil in the remainder of the oil-wetted passages or cavities in fluid communication with the pressure housing 236 also increases. These passages or cavities include the first cavity 114 of the bull plug assembly 110, the wireways 160, 173, 179 of the turbine 132, and the interiors of the housing 240 of the gearbox 232 and the housing 248 of the alternator 234.)

The above-noted configuration of the piston 286 and the first and holes 290, 294 thus causes the pressure of the lubricating oil within the power-generating device 10 to increase as the static pressure of the drilling mud increases. More particularly, the above-noted configuration tends to minimize the pressure differential between of the lubricating oil and the static pressure of the drilling mud. (In other words, the oil system of the power-generating device 10 functions as a pressure-compensating system.)

The spring 288 biases the piston 286 toward the forward direction, as discussed above. Hence, the spring 288 further increases the pressure of the lubricating oil. The spring constant (spring rate) of the spring 288 is preferably chosen so that the pressure of the lubricating oil is higher than the static pressure of the drilling mud by a predetermined amount, e.g., 45 psi. This feature helps to ensure that any leakage between oil-wetted and non-oil-wetted areas occurs as leakage of oil from the oil-wetted areas. In other words, the pressure differential between the oil-wetted and non-oil-wetted areas discourages contaminants from leaking into the oil-wetted areas. This feature can be particularly beneficial, for example, during transient operation of the power-generating device 10, when the pressure balance across the seal assembly 188 can be temporarily upset.

The electronics control module 300 comprises a pressure housing 302. The pressure housing 302 is mechanically coupled to the pressure plug 276 by way of the suspension 304 (see FIG. 5). The pressure housing 302 and the high-pressure feed thru 290 are mated using complementary threads formed on an inner surface of the pressure housing 302, and an outer surface of the pressure plug 276. The joint between the pressure housing 302 and the pressure plug 276 is preferably sealed through the use of O-ring seals 303 positioned in circumferentially-extending slots formed in the pressure plug 276.

The pressure housing 302 acts as a load-bearing structural element, in the manner discussed above in relation to the inlet housing 140, stator housing 142, and outlet housing 144 of the turbine 132, and the pressure housing 236 of the mechanical module 230. The pressure housing 302 is preferably formed from a high-strength, corrosion-resistant material such as Inconel 718 alloy, 17-4PH stainless steel, copper berilium alloy, etc. (The pressure housing 302 contains air at approximately atmospheric pressure during drilling operations, as discussed above. Hence, the pressure housing 302 is preferably constructed with a greater wall thickness than the pressure housing 236, to accommodate the relatively large pressure differential that can occur between the interior and exterior of the pressure housing 302 during drilling operations.)

The electronics module 300 also includes a suspension 304, a voltage regulator 306, and rectifier 308 (see FIG. 5). The suspension 304 is secured to the pressure plug 276. The voltage regulator 306 and rectifier 308 are suspended by the suspension 304 (when the power-generating device 10 is vertically orientated).

The wires 284 extend into the pressure housing 302 from the high-pressure feed thrus 282 of the pressure plug 276 by way of the passages 283, and are electrically connected to the voltage regulator 306 or the rectifier 308.

The voltage regulator 306 regulates the output voltage of the alternator 234. The rectifier 308 converts the output of the alternator 234 from alternating current to direct current. The voltage regulator 306 and rectifier 308 are mounted on a chassis 310.

The electronics module 300 can include a trim resistor (not shown) for adjusting the voltage output of the turbine power-generating device 10.

The electronics module 300 further comprises a multi-pin electrical connector 314. (It should be noted that the configuration of the connector 314 is application dependent. Other types of connectors can be used in alternative embodiments.) The connector 314 tethered to the chassis 310, and is electrically coupled to a voltage regulator and rectifier assembly 306 by a wiring harness 312. The connector 314 mates with a complementary connector on the piece of equipment, e.g., the crossover 22, located immediately down-hole of the turbine alternator-unit 10 (see FIG. 8). The connector 314 can transmit electrical power and electrical signals between the power-generating device 10 and the piece of equipment.

The use of the power-generating device 10 can obviate the need for a battery to power electrical equipment located in the drill hole. Hence, the costs associated with replacing batteries can be eliminated through the use of the power-generating device 10. Moreover, the interruptions in drilling operations caused by the need to replace batteries, and the potentially costly down-time associated with such interruptions, can also be eliminated. Moreover, the power-generating device 10 is believed to be a more reliable power source than batteries.

The power-generating device 10, it is believed, can provide five to ten times more electrical power than a conventional battery having a comparable form factor. This feature is particularly beneficial in drilling operations, where the space available to accommodate equipment such as batteries can be severely limited. For example, the particular embodiment of the power-generating device 10 disclosed herein can provide 150 watts of power at 28–40 volts, and has a maximum diameter (at the turbine 132) of approximately 3.13 inches.

Moreover, positioning the turbine 132 and the alternator 232 at different axial locations within the power-generating device 10 can help to minimize the form factor of the power-generating device 10. The use of the inlet housing 140, stator housing 142, outlet housing 144, and pressure housings 236, 302 as load-bearing elements can further help to minimize the form factor.

The power-generating device 10, it is believed, is better suited than a battery to withstand the relatively high temperatures that can occur within a drill hole during drilling operations. For example, the particular embodiment of the power-generating device 10 disclosed herein can be operated at temperatures of up to approximately 200° C. (393° F.).

The ability to transmit electrical power and electrical signals through the power-generating device 10 can facilitate the use of electrical equipment down-hole from the power-generating device 10. For example, an accessory such as a gamma sensor or a resistivity sensor (not shown) can be located in the collar 12, down-hole from the power-generating device 10. The power-generating device 10 can be used to power the sensor. The wiring that transmits electrical power and signals to and from the sensor is routed entirely within the power-generating device 10. Hence, the wiring is substantially isolated (and protected) from the relatively harsh environment within the drill hole.

Isolating the alternator 234 from the environment within the drill hole can enhance the reliability of the alternator 234. In particular, drilling mud often contains metallic debris can accumulate on the magnets of an alternator and thereby interfere with the operation of the alternator. Immersing the magnets 266 in an oil-wetted environment within the power-generating device 10 can substantially eliminate the possibility for such contamination. Moreover, the use of a pressure-compensating oil system that operates a higher-than-ambient pressure helps to inhibit contaminates such as drilling mud from entering the power-generating unit 10.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

PARTS LIST

Power-generating unit 10
Drilling collar 14
Inner surface 15 (of drilling collar 14)
Pulser assembly 16
Video camera 25
Crossover 20
Bull plug assembly 110
Body 111 (of bull plug assembly 110)
First cavity 114 (of body 111)
Second cavity 116
Connector 117
Wires 118
High-pressure feed thru 120 (of bull plug assembly 110)
Body 122 (of high-pressure feed thru 120)
Pins 124
Wires 126
Collar 130
Turbine 132
Inlet housing 140 (of turbine 132)
Stator housing 142
Outlet housing 144
Rotor assembly 146
Shaft 148
Main portion 150 (of inlet housing 140)
Legs 152
Shroud 154
O-ring seals and back-up rings 156
First cavity 159 (in inlet housing 140)
Wireways 160 (in housing 140)
Passages 162 (in inlet housing 14)
Second cavity 164 (in inlet housing 140)
O-ring seal 166
Slot 168 (in inlet housing 140)
Shroud 170 (of stator housing 142)
Stator blades 172
Wireways 173 (in shroud 170)
Main portion 174 (of outlet housing 144)
Legs 176
Shroud 178
Wireways 179 (in outlet housing)
Passage 180 (in outlet housing 144)
First cavity 181
Second cavity 182
Central passage 183
Needle bearing 184
Seal assembly 188
Rotary face 190 (of seal assembly 188)
Stationary face 192
Seal housing 194
Retainer 196
Spring 198
O-ring seals 200, 202
Bearings 208
First stage 220 (of rotor assembly 146)
Second stage 222
Hubs 224 (of first and second stages 220, 222)
Blades 226
Spacer 228
Mechanical module 230
Gearbox 232
Alternator 234
Pressure housing 236 (of mechanical module 230)
Inner surface 237 (of the pressure housing 236)
O-rings and back-up rings 238
Housing 240 (of gearbox 232)

Support member 241
Pinion gear 242
Second gear 244
Planetary gears 245
Output shaft 247 (of gearbox 232)
Housing 248 (of alternator 236)
Armature 250
Main portion 252 (of armature 250)
Input portion 254
Torque coupling 255
First bearing 258
Second bearing 260
Adapter 262
Clamp 263
Support 264
Stub portion 265 (of armature 250)
Permanent magnets 266 (of alternator 234)
O-ring 267
Windings 269 (of alternator 234)
Layer of adhesive 273
Through holes 274 (in housing 248)
Wireways 275
Pressure plug 276
Body 278 (of pressure plug 276)
O-ring seals and back-up rings 279
High-pressure feed thru 282
Passages 283 (in body 278)
Wires 284
Piston 286 (of pressure plug 276)
Spring 288
Bore 290 (in body 278)
O-ring seal 292
Hole 294 (in body 278)
Electronics control module 300
Pressure housing 302 (of electronics module 300)
O-rings seals 303
Suspension 304
Voltage regulator 306
Rectifier 308
Chassis 310
Wiring harness 312
Connector 314

What is claimed is:

1. A power-generating device for use in drilling operations, comprising:

a turbine comprising a housing, and a rotor assembly rotatably coupled to the housing so that the rotor assembly rotates in response to the passage of drilling mud therethrough;

one of an alternator and a generator assembly comprising a magnet, a winding, and a housing, one of the magnet and the winding being fixedly coupled to the housing of the one of an alternator and a generator, and the other of the magnet and the winding being coupled to the rotor assembly so that rotation of the rotor assembly causes a magnetic field of the magnet to pass through the winding thereby causing the one of an alternator and a generator to generate electrical power; and one or more wires for transmitting electrical signals between a first and a second electrical component by way of the power-generating device, wherein the one or more wires are routed through the housing of the turbine and the housing of the one of an alternator and a generator.

2. The power-generating device of claim 1, wherein the one of an alternator and a generator comprises two of the windings, and the one or more wires are routed between the two of the windings.

3. The power-generating device of claim 1, wherein the one or more wires pass through a wireway formed in a first end of the housing of the one of an alternator and a generator.

4. The power-generating device of claim 3, wherein the one or more wires pass through a wireway adjoining a second end of the one of an alternator and a generator.

5. The power-generating device of claim 1, further comprising a bull plug assembly comprising a body mechanically coupled to the housing of the turbine, and a high-pressure feed thru mounted on the body for substantially isolating a first cavity of the bull plug assembly from a second cavity of the bull plug assembly, the high-pressure feed thru comprising one or more electrically-conductive pins extending between the first and second cavities, the one or more wires being electrically connected to the one or more pins.

6. The power-generating device of claim 1, wherein the housing of the turbine comprises:

an inlet housing having a main portion and a shroud circumferentially spaced from the main portion to form a passage for directing the drilling mud toward the rotor assembly;

a stator housing having a shroud and a plurality of stator blades extending radially inward from the shroud of the stator housing for altering a direction of travel of the drilling mud; and an outlet housing having a main portion and a shroud circumferentially spaced from the main portion of the outlet housing to form a passage for directing the drilling mud away from the rotor assembly.

7. The power-generating device of claim 6, wherein the inlet, stator, and outlet housing transmit mechanical structural loads between a first and a second end of the power-generating device.

8. The power-generating device of claim 6, wherein:

the inlet housing further comprises a leg adjoining the main portion and the shroud of the inlet housing and having a wireway formed therein;

the outlet housing further comprises a leg adjoining the main portion and the shroud of the outlet housing and having a wireway formed therein;

the shroud of the stator housing has a wireway formed therein; and the one more wires are routed through the wireways formed in the leg of the inlet housing, the leg of the outlet housing, and the shroud of the stator housing.

9. The power-generating device of claim 6, wherein the outlet housing has a cavity formed therein and the turbine further comprises (i) a shaft fixedly coupled to the rotor assembly, (ii) a bearing for rotatably coupling the shaft to the outlet housing and being disposed at least in part within a cavity formed in the outlet housing, and (iii) a rotating face seal, the rotating face seal comprising a rotary face concentrically disposed around the shaft, and a stationary face fixedly coupled to the outlet housing and abutting the stationary face so that a contact pressure between the rotary face and the stationary face substantially seals the cavity.

10. The power-generating device of claim 1, wherein:

the turbine further comprises a first shaft fixedly coupled to the rotor assembly;

the power-generating device further comprises a gearbox having a first gear fixedly coupled to the first shaft, and a second gear fixedly coupled to a shaft of the one of an alternator and a generator; and the first gear drives the second gear so that a rotational speed of the second shaft is less than a rotational speed of the first shaft.

11. The power-generating device of claim 10, further comprising a pressure housing mechanically coupled to the housing of the turbine, wherein the one of an alternator and a generator and the gearbox are housed within the pressure housing and the one or more wires are routed between an outer casing of the gearbox and an inner surface of the pressure housing.

12. The power-generating device of claim 1, wherein the rotor assembly comprises a hub rotatably coupled to the housing of the turbine, and a plurality of blades fixedly coupled to the hub, wherein the blades cause the hub to rotate in response to passage of the drilling mud over the blades.

13. The power-generating device of claim 1, wherein the one of an alternator and a generator further comprises an armature having a main portion, an input potion rotatably coupled to the housing of the one of an alternator and a generator by way of a first bearing, and a stub portion rotatably coupled to the housing of the one of an alternator and a generator by way of a second bearing, the other of the magnet and the winding being fixedly coupled to the main portion of the armature.

14. The power-generating device of claim 1, further comprising a first pressure housing mechanically coupled to the housing of the turbine for housing the one of an alternator and a generator, a second pressure housing, and a bull plug assembly for substantially isolating an interior of the first pressure housing from an interior of the second pressure housing, the bull plug assembly comprising a body mechanically coupled to the first and second pressure housing, and a high-pressure feed thru mounted on the body and comprising one or more electrically-conductive pins extending therethrough, wherein the one or more wires are electrically connected to the one or more pins.

15. The power-generating device of claim 14, further comprising a voltage regulator and rectifier assembly mounted in the second pressure housing for regulating and rectifying an output of the one of an alternator and a generator.

16. The power-generating device of claim 1, further comprising:

a pressure housing for housing the one of an alternator and a generator, a first end of the first pressure housing being mechanically coupled to the housing of the turbine and the pressure housing having lubricating oil therein; and a bull plug assembly mechanically coupled to the pressure housing and comprising (i) a body mechanically coupled to a second end of the pressure housing; (ii) a high-pressure feed thru comprising one or more electrically-conductive pins electrically connected to the one or more pins; (iii) a piston, the body having a bore formed therein for receiving the piston, the bore facing an interior of the pressure housing so that a first side of the piston is in fluid communication with the interior of the pressure housing, the body having a hole formed therein and extending between the bore and an exterior surface of the body so that a second side of the piston is in fluid communication with an ambient environment around the power-generating device; and (iv) a spring for biasing the piston toward the interior of the pressure housing.

17. The power-generating device of claim 1, further comprising a seal positioned around the turbine for sealing an interface between the power-generating device and a drilling collar that receives the power-generating device so that substantially all of the drilling mud passing through the collar is directed into the turbine.

18. The power-generating device of claim 1, wherein the one or more wires are routed between an up-hole and a down-hole end of the housing of the turbine, and between an up-hole and a down-hole end of the housing of the alternator.

19. A power-generating device for use in drilling operations, comprising:

a turbine comprising a housing and a rotor assembly, the rotor assembly comprising a hub and a plurality of blades fixedly coupled to the hub, the rotor assembly being rotatably coupled to the housing so that the rotor assembly generates a first torque in response to the passage of drilling mud over the blades;

a gearbox mechanically coupled to the turbine so that a torque approximately equal to the first torque is input to the gearbox, the gearbox comprising a plurality of gears for increasing the torque approximately equal to the first torque so that the gearbox generates an output torque greater than the torque approximately equal to the first torque; and one of an alternator and a generator for generating electrical power and comprising a magnet and a winding, the one of an alternator and a generator being mechanically coupled to the gearbox so that the one of the magnet and the winding rotates in relation to the other of the magnet and the winding in response to the output torque.

20. The power-generating device of clam 19, wherein the gearbox is positioned between the turbine, and the one of an alternator and a generator.

21. The power-generating device of clam 19, wherein the gearbox further comprises a housing for the plurality of gears.

22. A power-generating device, comprising:

a turbine comprising a first housing, a bearing, and a rotor assembly rotatably coupled to the first housing by way of the bearing so that the rotor assembly rotates in response to the passage of drilling mud therethrough, at least a portion of the bearing being located in a cavity defined by the first housing, the cavity having lubricating oil therein;

one of an alternator and a generator, the one of an alternator and a generator comprising a magnet, a winding, and a second housing for magnet and the winding, the second housing having lubricating oil in an interior thereof, the one of an alternator and a generator being mechanically coupled to the rotor assembly so that rotation of the rotor assembly causes relative movement between the magnet and the winding thereby causing the one of an alternator and a generator to generate electrical power; and a piston, a first side of the piston being in fluid communication with the cavity and the interior of the second housing, and a second side of the piston being in fluid communication with an ambient environment around the power-generating device so that a pressure of the lubricating oil in the cavity and the second housing varies in response to a variation in a pressure of the ambient environment.

23. The power-generating device of claim 22, further comprising a bull plug assembly mechanically coupled to the one of an alternator and a generator, the bull plug assembly having a body, the body having a bore formed therein for receiving the piston, and a hole adjoining the bore and an outer surface of the body so that the bore fluidly communicates with the ambient environment by way of the hole.

24. The power-generating device of claim 22, further comprising a spring for biasing the piston toward the interior of the second housing.

25. A power-generating device, comprising:

a turbine comprising a housing, a bearing located at least in part within a cavity defined by the housing, a rotor assembly being rotatably coupled to the housing by way of the bearing so that the rotor assembly rotates in response to the passage of drilling mud through the rotor assembly, a shaft fixedly coupled to the rotor assembly, and a seal assembly comprising (i) a rotary face concentrically disposed around the shaft, and (ii) a stationary face fixedly coupled to the housing and abutting the rotary face so that a contact pressure between the rotary face and the stationary face substantially seals the cavity; and one of an alternator and a generator comprising a magnet, a winding, and a housing, one of the magnet and the winding being fixedly coupled to the housing of the alternator, and the other of the magnet and the winding being coupled to the shaft so that rotation of the rotor assembly causes a magnetic field of the magnet to pass through the winding thereby causing the one of an alternator and a generator to generate electrical power.

26. The power-generating device of claim 25, wherein the seal assembly further comprises a seal housing for housing the stationary face, a retainer for retaining the stationary face in the seal housing, and a spring for biasing the stationary face toward the rotary face.

27. The power-generating device of claim 26, further comprising:

a first O-ring seal positioned within a groove formed in the rotary face for sealing an interface between the rotary face and the shaft; and a second O-ring seal positioned within a groove formed in the seal housing for sealing an interface between the stationary face and the seal housing.

28. The power-generating device of claim 25, wherein the contact pressure between the rotary face and the stationary face is proportional to a pressure differential across the seal assembly.

* * * * *

UNITED STATES PATENT AND TRADEMARK OFFICE

CERTIFICATE OF CORRECTION

PATENT NO. : 7,201,239 B1
APPLICATION NO. : 10/837727
DATED : April 10, 2007
INVENTOR(S) : Carl Allison Perry It is certified that error appears in the above-identified patent and that said Letters Patent is hereby corrected as shown below:

On the title page, item (73), delete "APS Technologies, Inc." and insert --APS Technology, Inc.--

Signed and Sealed this

Twelfth Day of August, 2008

JON W. DUDAS
*Director of the United States Patent and Trademark Office*